United States Patent [19]

Ernst et al.

[11] 4,218,795

[45] Aug. 26, 1980

[54] DRILL BIT WITH FASTENER-DRIVING COLLAR ASSEMBLY

[75] Inventors: Richard J. Ernst, Palatine; Elbert E. Williams, Jr., Elk Grove Village, both of Ill.

[73] Assignee: Illinois Tool Works Inc., Chicago, Ill.

[21] Appl. No.: 18,382

[22] Filed: Mar. 7, 1979

[51] Int. Cl.[2] ..... B26B 11/00

[52] U.S. Cl. ..... 7/158

[58] Field of Search ..... 7/138, 158; 145/50 B, 145/61 R, 116 R; 81/12.4 R, 54

[56] References Cited

U.S. PATENT DOCUMENTS

| | | | |
|---|---|---|---|
| 118,178 | 8/1871 | Arnold . | |
| 260,314 | 6/1882 | Chuck . | |
| 354,155 | 12/1886 | Libbey . | |
| 1,209,362 | 12/1916 | Turner . | |
| 2,482,995 | 9/1949 | Willis | 64/29 |
| 3,136,347 | 6/1964 | Linquist . | |
| 3,336,611 | 8/1967 | Schepp | 7/158 |
| 3,484,114 | 12/1969 | Rodin | 279/1 |
| 3,534,640 | 10/1970 | Macy | 77/71 |
| 3,932,904 | 1/1976 | Nilsson et al. | 7/158 |
| 3,965,510 | 6/1976 | Ernst | 7/158 |
| 4,007,795 | 2/1977 | Gawron et al. | 173/50 |
| 4,092,753 | 6/1978 | Fuhrmann | 7/158 |
| 4,107,800 | 8/1978 | Jorgensen | 7/158 |

*Primary Examiner*—James G. Smith

*Attorney, Agent, or Firm*—Richard K. Thomson; Robert W. Beart

[57] ABSTRACT

A two piece hole-drilling and fastener-driving assembly consists of a three-sectioned drill bit and a three-sectioned drive collar. The drill bit has a fluted drilling section, a hexagonal driving section and a tapered section adapted to be received in a complementarily shape chuck of a rotary hammer. The drive collar has a first hexagonal portion which mates with the hexagonal drill bit section and is driven thereby. A second tubular portion receives the drilling section when the hexagonal portions are engaged. A third portion includes a fastener-engaging recess. This portion may take the form of a removable socket and the collar provided with a spring-biased ball retainer to hold the socket thereon and a second such retainer to hold the collar on the drill bit. The drill bit is inserted in the rotary hammer chuck and a hole is drilled in the workpiece. The drive collar is then slipped over the drill bit and a self-tapping fastener driven into the just-drilled hole.

7 Claims, 3 Drawing Figures

DRILL BIT WITH FASTENER-DRIVING COLLAR ASSEMBLY

BACKGROUND OF THE INVENTION

This application is related to U.S. application Ser. No. 23,519 filed Mar. 23, 1979.

This invention relates to a tool assembly which can both drill a hole and, with minor modification, drive a self-tapping fastener into that hole.

Tools of this general type have been disclosed in commonly owned U.S. Pat. Nos. 3,965,510 and 4,107,800 which disclosures are hereby incorporated by reference. In each of those patents, a drill bit is retained in a mandrel by means of a setscrew. The mandrel has a stem portion which may extend from, or be telescopically received in, a sleeve. The sleeve has a fastener-engaging socket on the end opposite to that from which the stem projects. When the stem is in the forward position, it is contained within the sleeve and the drill bit is in its projecting or operative position. When the stem is in its rearward position, the drill bit is withdrawn into the sleeve and the socket is foremost such that it can engage and drive a fastener.

These combination tools have proved highly successful for most drilling and driving applications. However, certain limitations of these tools render them not entirely suitable for certain applications. More specifically, these tools are not well suited for use with the high-powered rotary hammer, or hammer drill, which is capable of both rotational and percussive driving. When subjected to the high vibration of such a driver, the setscrews which retain the drill bits in the above mentioned combination tools tend to vibrate loose, regardless of the amount of torque used to tighten them.

A further problem with these tools occurs with the larger drill sizes which, coincidentally, require the high powered tools to drive them and their corresponding fasteners. For every inch of length added to the drill bit, roughly two inches must be added to the tool, one inch to the sleeve and one inch to the stem which must reach through that sleeve. For the large fastener sizes, this means the portion of the stem received in the driver is a substantial distance from the fastener-engaging socket and, even farther yet from the tip of the fastener which is penetrating the material. This means the tool itself is subjected to increased rotational and longitudinal bending torques and the fastener is subjected to a greater risk of canting or misalignment. Further, these prior art devices must have a longitudinal recess the drill can pass through and, therefore, can only be used with an external-type driver.

SUMMARY OF THE INVENTION

It is an object of this invention to provide a hole-drilling and fastener-driving assembly suitable for use with a rotary hammer.

More particularly, it is an object of the invention to provide a hole-drilling and fastener-driving assembly in which the means of connection will not loosen when subjected to vibration.

It is a further object of this invention to provide a hole-drilling and fastener-driving assembly which has a relatively short distance between the portion inserted in the driver and fastener-engaging socket when the assembly is in the driving mode.

These and other objects of the invention are achieved by a one-piece, three-sectional drill bit means which has a first fluted drilling section, a polygonal second driving section and a third tapered section adapted to be received in a tapered chuck of a rotary hammer. The drill bit means is inserted in the chuck and frictionally driven thereby to drill a suitably sized hole in a workpiece. A drive collar means is then slipped over the drill bit and a portion at one end thereof meshes with the polygonal driving section so that torque is transmitted thereto. The drive collar means has a sufficient length to accomodate the drill portion of the largest sized bit with which it will be used. A socket is provided at the other end of the drive collar which engages the head of a self-tapping fastener and drives it into the just-drilled hole. As an alternative, the end of the drive collar can receive a screwdriver bit capable of engaging an internal drive surface.

These and other objects and advantages of the present invention will be better understood by reference to the following detailed description taken in conjunction with the accompanying drawings.

DETAILED DESCRIPTION OF THE INVENTION

Figure 3:
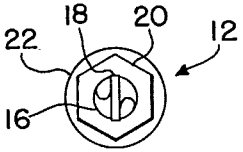
FIG. 3 is an end view of the drill bit of the present invention.

The hole-drilling and fastener driving assembly of the present invention comprises a drill bit means shown generally at 12 and a drive collar means shown generally at 14. The drill bit 12 consists of a one piece, three-sectioned member with all of the sections lying along a common axis. The first section 16 is the drilling section which has two flutes extending thereabout in a conventional manner. The first section extends from the drill tip 18 at its one end to the larger diametered second section 20 at its other. As can be seen most clearly in FIG. 3, the second section has a generally hexagonal configuration for reasons which will become clear herebelow.

The third section 22 gradually tapers downwardly from the portion adjacent the second section to a flat end 28 opposite the drill tip. The third section has a generally circular cross section and, accordingly, the section is frustoconical. The third section is adapted to be inserted into a similarly-shaped, axially-extending aperture 26 of a rotary hammer 24. When the dril bit is inserted into the chuck, the flat end 28 thereof will project beyond the end of the aperture 26 and will project into recess 30. This will permit removal of the bit by the insertion of a knockout pin (not shown) into recess 30. The major diameter of the third section exceeds the minimum dimension of the second section which is measured from the center of one face diametrically to the opposite extremity.

Figure 1:
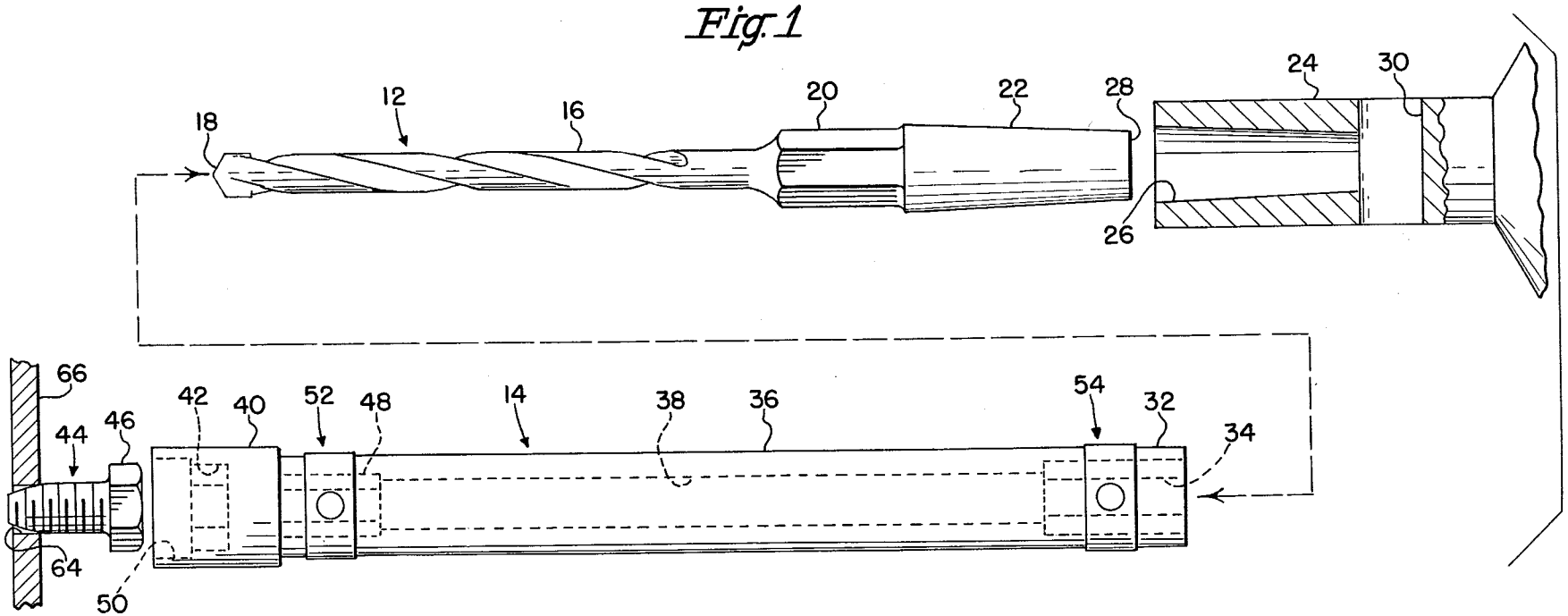
FIG. 1 is an exploded perspective view of the drill bit and fastener-driving assembly of the present invention with the rotary hammer chuck shown in partial cross section.
Figure 2:
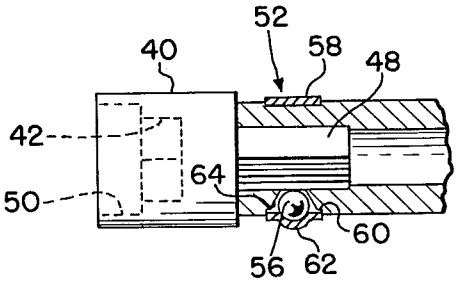
FIG. 2 is a perspective view of the socket with the end of the drive collar shown in section to indicate the manner of attachment.

The drive collar means 14 has at least three distinct portions. The first portion 32 has a longitudinal opening 34 which has a hexagonal configuration that is complementary to, and adapted to receive, the hexagonal second section of the drill bit. This drive-receiving portion 32 thereby permits the torque of the driver to be transmitted to the drive collar by means of the drill bit. The second portion 36 has a longitudinally extending passageway 38 of sufficient diameter and length to accommodate the largest sized drill bit with which it is to be used. The third portion includes a socket means 40 with a fastener-engaging recess 42 which has a hexagonal configuration adapted to engage the head 46 of a threadcutting screw 44. As shown in FIGS. 1 and 2, the socket portion 40 may be made removable by the use of a hexagonal stem 48 made integral with the socket 40 and adapted to be received in a similarly shaped aperture. This will permit the use of a variety of sized sockets for different sized fastener heads. It has been found beneficial to include a cylindrical recess 50 which has a diameter greater than the maximum diameter of head 46 and a depth substantially equal to the thickness of the head. This nondriving recess will prevent over-torquing of the fastener which may cause stripping of the threads which have been cut in the material or twist off the fastener head.

The separable socket 40 is secured to the remainder of the drive collar by a ball-spring shown generally at 52. A similar means 54 is used to retain the collar on the drill bit when it is to be employed. Since ball-springs 52 and 54 are substantially identical only one need be described in detail.

Ball-spring 52 comprises a spherical ball 56 and a spring clip 58. The clip 58 extends about a substantial portion of the drive collar and may be accomodated in a groove 60 extending about the periphery thereof. The clip has an indentation 62 to accomodate a portion of the ball 56. A recess 64 is drilled in the side wall of the drive tube in the center of the respective inner hexagon-forming wall. The inner diameter of recess 64 is insufficient to permit the ball to pass through. The diameter of the ball is greater than the wall thickness of the drive collar 14 such that when the hexagonal aperture is empty, spring clip 58 biases ball 56 so that it projects beyond the surface of the inner wall. Indentation 62 prevents the clip 58 from rotating relative to the drive collar and also permits the clip to remain in groove 60 when the ball is displaced.

When stem 48 is inserted into the hexagonal aperture thereof, or drive collar 14 slipped over drill bit 12, one face of the corresponding hexagonal shank will engage the respective ball 56 and displace it outwardly. Spring 58 will maintain the ball in gripping frictional engagement with that face and hold the two members together until manual removal is effected.

In operation, an appropriately sized drill bit 12 for the particular size of fastener 44 is inserted into chuck 24 of a rotary hammer. It will be understood that each drill bit has the same size second and third sections. Tapered section 22 is engaged and frictionally driven by tapered aperture 26. The hole 64 is drilled into the workpiece 66 by the drilling portion 16. Drive collar 14 is then slipped over the drill bit with hexagonal aperture 34 engaging section 20. Ball-spring 54 retains collar 14 against axial displacement. An appropriately sized socket 40 has been preassembled on the drive collar and ball-spring 52 retains it thereon. The head of the selftapping fastener 44 is inserted in socket 42 and the fastener is driven into the just-drilled hole.

The features which render the present invention better suited for use with rotary hammers should be obvious in light of the foregoing discussion. The various retaining means cannot vibrate loose. Collar 14 need be increased only one inch for every inch of drill length, as opposed to the two inch increase previously necessary. Rotary hammers are made to accomodate tapered driver bits so no adaptor is necessary. If the hexagonal surface 20 should become damaged i.e., by rounding of the corners, it can be replaced much more simply and cheaply than if the drive surface were on the driver itself. The sockets and drills may be easily changed for different sized fasteners.

Although a particular embodiment has been disclosed, it will be understood by those skilled in the art that various changes can be made. More particularly it will be understood that the mating hexagonal members can take any polygonal configuration: triangular, rectangular, pentagonal, octagonal, etc. In fact, any non-circular configuration (elliptical, lobular, etc.) might be used. Hexagonal is the most conventional driving shape and, for this reason, it has been depicted. It will further be understood that if desired the tapering section 22 may have a cross section other than round, i.e., rectangular, elliptical, etc. In fact, this section could be cylindrical and be retained by a ball or pin engaging in a groove. Also the spring clip could take the form of an equivalent means such as an elastic polyurethane band. These and other changes, alternatives, modifications and variations will be apparent to the skilled artisan in light of the foregoing description. Accordingly, it is intended that all such changes, modifications, alternatives and variations as are encompassed by the spirit and scope of the appended claims come within the invention.

We claim:

1. A hole-drilling and fastener driving assembly comprising drill bit means and drive collar means; the drill bit means comprising a three-sectioned, one-piece member having a drill tip, a first section, a second section and a third section all extending along a common axis; said first section comprising a fluted drilling section extending from the drill tip to the start of the second section; said second section having a polygonal configuration which defines a first radial dimension extending from one apex of the polygon to a diametrically opposed portion; said second section joining with the third section; said third section having a major radial dimension exceeding said first dimension and gradually tapering downwardly toward the end opposing the drill tip, said third section being adapted to be received in a correspondingly shaped aperture of a chuck of a rotary hammer; said drive collar means including first, second and third portions, said first portion constituting the drive receiving portion and having a polygonal aperture corresponding to and being adapted to receive the polygonal section of the drill bit means, said second portion having a longitudinally extending aperture of sufficient diameter and length to house the drill tip and drilling section of the bit means, said third portion including a fastener-engaging recess adapted to engage and drive the head of a self-tapping fastener, whereby the drill bit means may be inserted in and frictionally driven by said chuck to create a hole in a workpiece and the drive collar means subsequently slipped thereover and drive torque transmitted to said collar means from the drill bit means by the mating polygonal section and aperture and, in turn, from the drill bit means to the fastener by means of the fastener engaging recess to advance the fastener into the just-drilled hole.

2. The hole-drilling and fastener-driving assembly of claim 1 wherein the drive collar means has an radially extending hole in the portion having the polygonal aperture, said hole receiving a portion of a spherical ball, said ball being maintained adjacent said hole by means of a spring clip which extends about at least a majority of the periphery of the drive collar means.

3. The hole-drilling and fastener-driving assembly of claim 1 wherein said fastener-engaging recess is contained in a separable socket means, each of said socket means being equipped with a polygonal stem portion which is received in a similarly shaped aperture in the end opposite to the drive-receiving portion and frictionally retained therein by a spring-biased ball.

4. The hole-drilling and fastener-driving assembly of claim 3 wherein the polygonal stem and aperture are hexagonal.

5. The hole-drilling and fastener-driving assembly of claim 1 wherein the tapering third section of the drill bit means is generally circular in cross section.

6. The hole-drilling and fastener-driving assembly of claim 1 wherein the tapering third section of the drill bit means has a frustoconical configuration.

7. The hole-drilling and fastener-driving assembly of claim 1 wherein the polygonal second section of the drill bit means and the corresponding drive-receiving aperture of the drive collar means are hexagonal.

* * * * *